US006272684B1

(12) United States Patent
Shih

(10) Patent No.: US 6,272,684 B1
(45) Date of Patent: Aug. 14, 2001

(54) WATERPROOF AND GAS PERMEABLE JACKET AND THE METHOD FOR MANUFACTURING IT

(76) Inventor: Liang-Kun Shih, No. 1, Alley 152, Lane 566, Sanfeng Rd., Fengyuan City, Taichung Hsien (TW)

( * ) Notice: Subject to any disclaimer, the term of this patent is extended or adjusted under 35 U.S.C. 154(b) by 0 days.

(21) Appl. No.: 09/238,498

(22) Filed: Jan. 27, 1999

(51) Int. Cl.[7] ..... A41D 3/04

(52) U.S. Cl. ..... 2/87; 2/81; 2/82; 2/85; 2/93; 2/97

(58) Field of Search ..... 2/81, 82, 85, 87, 2/93, 97, 457, 272, 904, DIG. 1

(56) References Cited

U.S. PATENT DOCUMENTS 4,194,041 * 3/1980 Gore et al. ..... 428/315
5,364,678 * 11/1994 Lumb et al. ..... 428/96
5,685,015 * 11/1997 Aldridge ..... 2/81
5,709,766 * 1/1998 Press et al. ..... 156/307.3
5,845,336 * 12/1998 Golde ..... 2/93

* cited by examiner

*Primary Examiner*—John J. Calvert
*Assistant Examiner*—Robert H. Muromoto, Jr.
(74) *Attorney, Agent, or Firm*—Charles E. Baxley

(57) ABSTRACT

A method provided for manufacturing a waterproof and gas permeable jacket includes the following steps: (a) providing a lining, a gas permeable layer including a first side and a second side, a waterproof film, and an outer cover; (b) forming a plurality of vent holes through the gas permeable layer; (c) bonding the waterproof film onto the first side of the gas permeable layer; (d) bonding the outer cover to the water-proof film; (e) bonding the lining to the second side of the gas permeable layer to form a laminated layer including the lining, the gas permeable layer, the waterproof film, and the outer cover; (f) cutting the laminated layer so as to form a plurality of cut edges; (g) bonding the cut edges of the laminated layer together; (h) sewing up the bonded cut edges of the laminated layer to form a semi-finished jacket; and (i) attaching a zipper to the semi-finished jacket to form a finished jacket.

5 Claims, 6 Drawing Sheets

WATERPROOF AND GAS PERMEABLE JACKET AND THE METHOD FOR MANUFACTURING IT

CROSS-REFERENCES TO RELATED APPLICATIONS

Not Applicable.

BACKGROUND OF THE INVENTION

1. Field of the Invention

The present invention relates to waterproof and gas permeable clothing such as a jacket, a vest and the like, and more particularly to waterproof and gas permeable clothing and the method for manufacturing it.

2. Description of the Related Art

The closest prior art of which the applicant is aware is disclosed in his U.S. patent application Ser. No. 08/918,995, filed on ???, entitled by "Waders and the Method for Manufacturing Them".

BRIEF SUMMARY OF THE INVENTION

In accordance with one aspect of the present invention, there is provided a waterproof and gas permeable jacket comprising a gas permeable layer having a first side and a second side, a waterproof film attached to the first side of the gas permeable layer, an outer cover attached to the waterproof film, and a lining attached to the second side of the gas permeable layer.

In accordance with another aspect of the present invention, there is provided a method for manufacturing a waterproof and gas permeable jacket that includes the following steps: (a) providing a lining, a gas permeable layer including a first side and a second side, a waterproof film, and an outer cover; (b) forming a plurality of vent holes through the gas permeable layer; (c) bonding the waterproof film to the first side of the gas permeable layer; (d) bonding the outer cover to the waterproof film; (e) bonding the lining to the second side of the gas permeable layer to form a laminated layer including the lining, the gas permeable layer, the water-proof film, and the outer cover; (f) cutting the laminated layer so as to form a plurality of cut edges; (g) bonding the cut edges of the laminated layer together; (h) sewing up the bonded cut edges of the laminated layer to form a semi-finished jacket; and (i) attaching a zipper to the semi-finished jacket to form a finished jacket.

Further features of the present invention will become apparent after a careful reading of the detailed description with appropriate reference to the accompanying drawings.

DETAILED DESCRIPTION OF THE INVENTION

Figure 1:
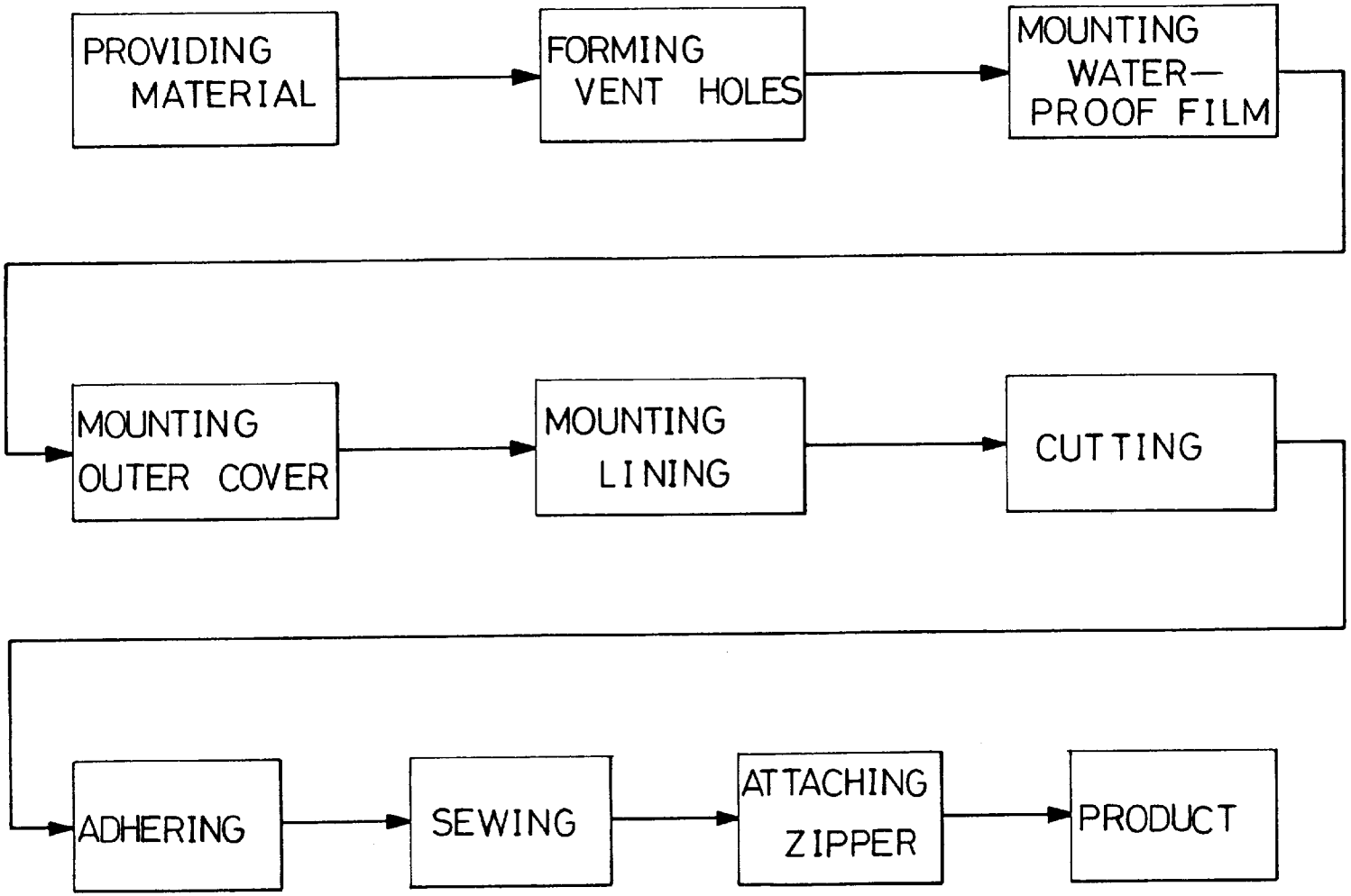
FIG. 1 is a flow chart of a method for manufacturing a waterproof and gas permeable jacket in accordance with the present invention.
Figure 2:
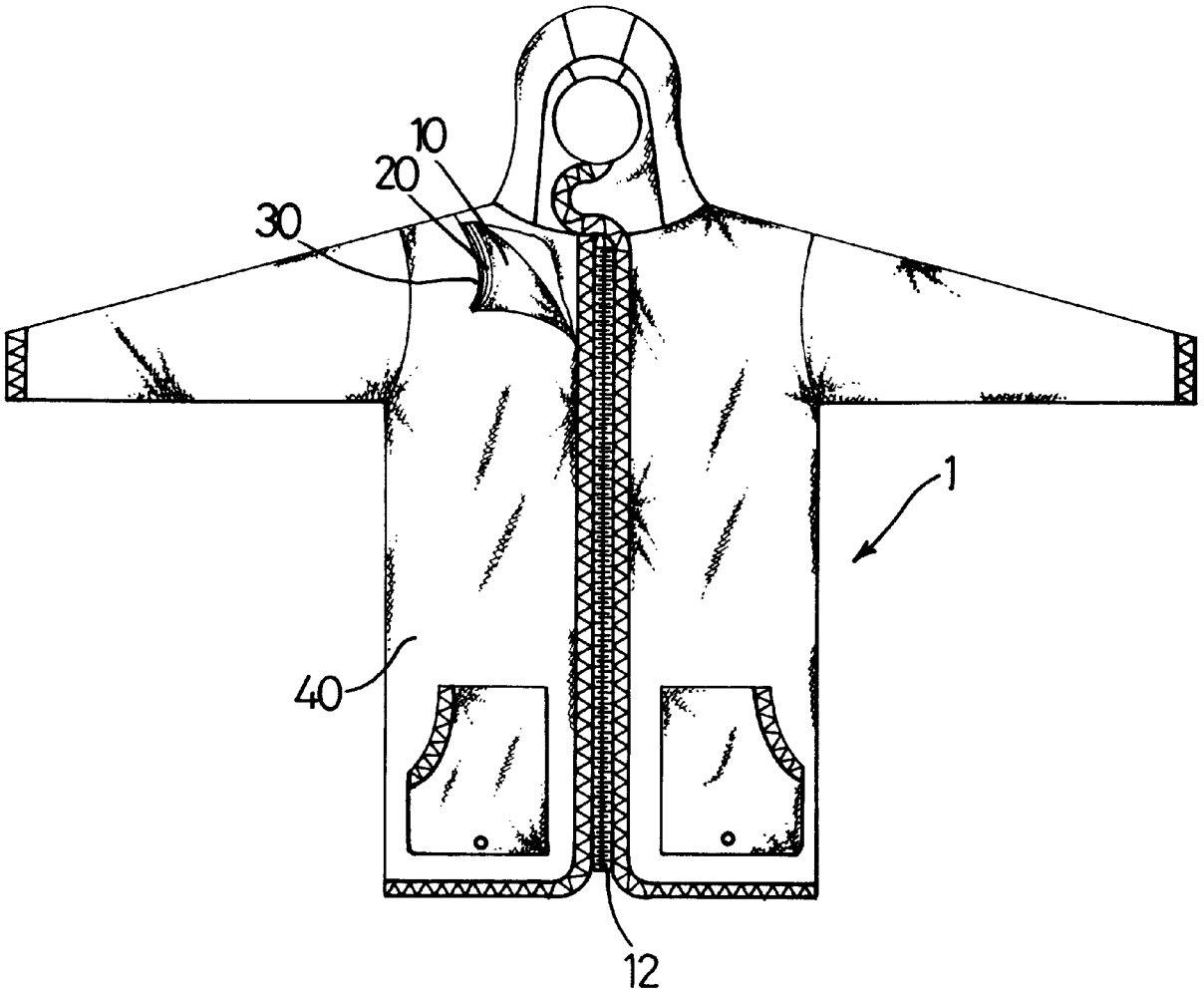
FIG. 2 is a front plan view of the waterproof and gas permeable jacket in accordance with the present invention.
Figure 3:
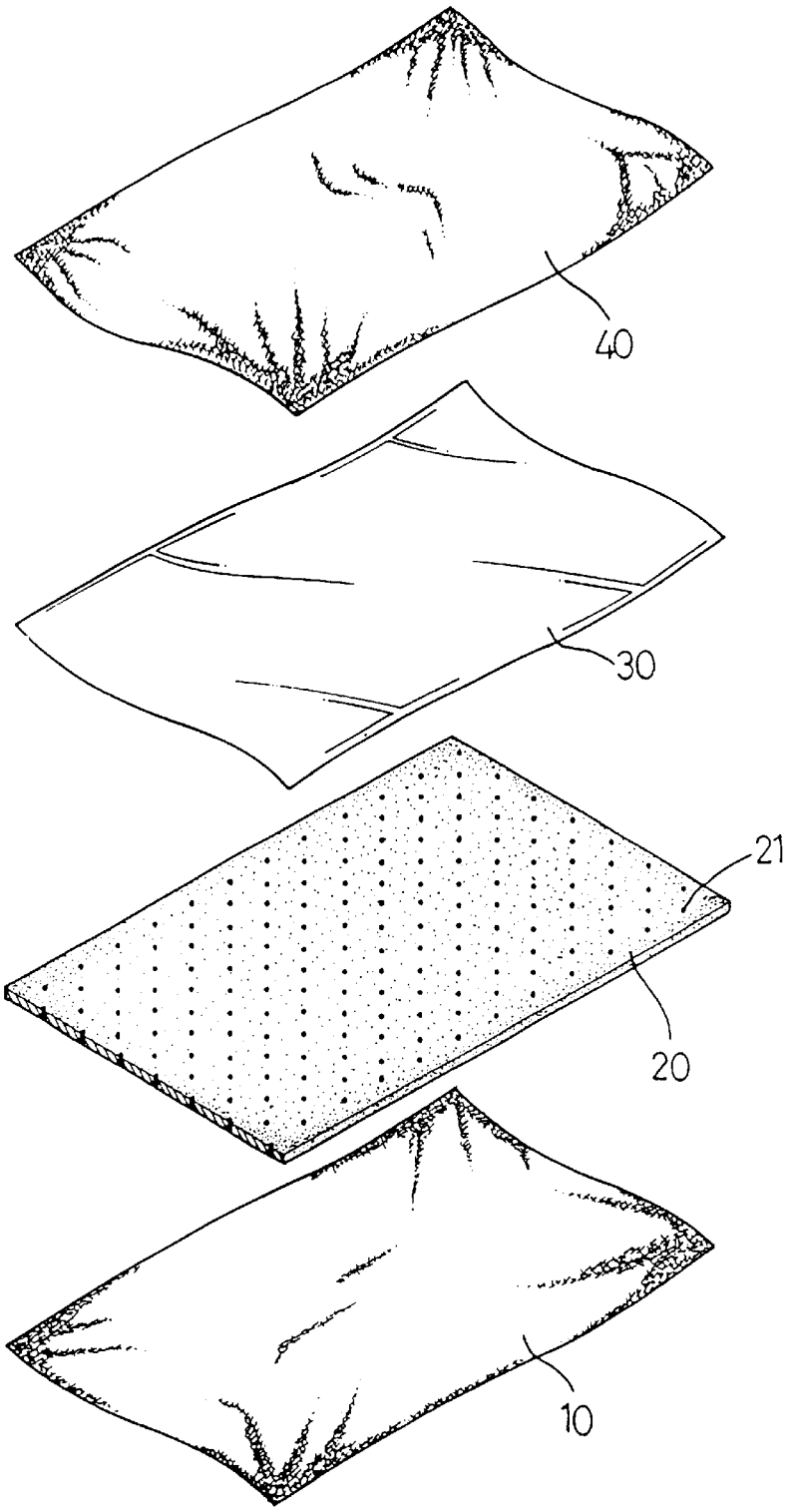
FIG. 3 is a partially exploded view of the waterproof and gas permeable jacket as shown in FIG. 2.
Figure 4:
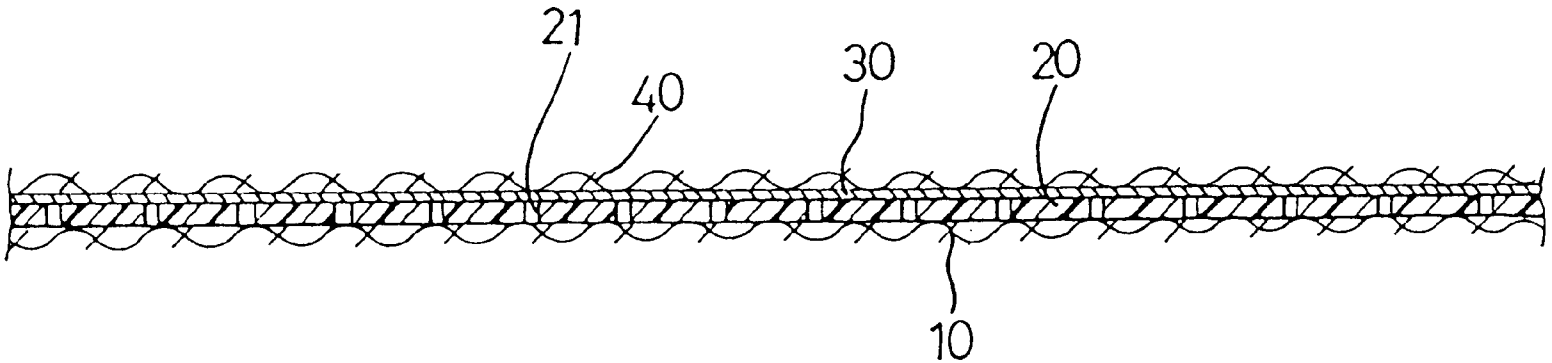
FIG. 4 is a front plan cross-sectional assembly view of the waterproof and gas permeable jacket as shown in FIG. 3.

Referring to the drawings, and initially to FIGS. 2–4, waterproof and gas permeable clothing such as a waterproof and gas permeable jacket (1) according to the present invention comprises a gas permeable layer (20) including a first side and a second side, a water-proof film (30) fixedly mounted on the first side of the gas permeable layer (20), an outer cover (40) fixedly bonded to the waterproof film (30), and a lining (10) fixedly bonded to the second side of the gas permeable layer (20).

The gas permeable layer (20) is made of a foam core material or synthetic rubber and contains a plurality of vent holes (21) defined therethrough. The waterproof film (30) is preferably made of polyurethane (P.U.). The outer cover (40) and the lining (10) are made of nylon cloth respectively.

When worn, a person can put on the jacket (1) with the lining (10) directly contacting his/her skin, and the outer cover (40) exposed to the surroundings. In such a manner, the gas permeable layer (20) is adapted to provide a ventilating effect to the wearer by means of the vent holes (21), thereby incurring a comfortable sensation. In addition, the waterproof film (30) can efficiently prevent water from entering and wetting the lining (10) through the vent holes (21), thereby achieving a waterproof feature.

Referring to FIGS. 1–5, a method in accordance with the present invention is used to manufacture a waterproof and gas permeable jacket (1) and comprises the following steps.

First, the lining (10), the gas permeable layer (20), the water-proof film (30), and the outer cover (40) are preselected, wherein the gas permeable layer (20) is made of a foam core material or a synthetic rubber, the water-proof film (30) is made of polyurethane (P.U.), and the outer cover (40) and the lining (10) are made of nylon cloth respectively.

Secondly, a plurality of vent holes (21) are formed in the gas permeable layer (20) by means such as a punching machine.

Figure 5:
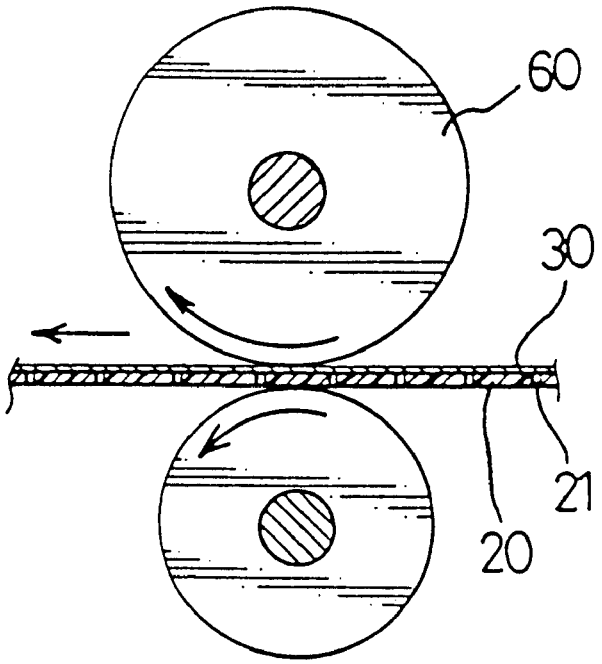
FIG. 5 is a front plan partially cross-sectional view showing two heating rolls for bonding a gas permeable layer and a waterproof film together.

Then, the waterproof film (30) is bonded to the first side of the gas permeable layer (20) by means such as adhesion. Preferably, the gas permeable layer (20) together with the waterproof film (30) are heated and pressurized between a pair of heating rollers (60) as shown in FIG. 5 such that the waterproof film (30) can be tightly bonded to the first side of the gas permeable layer (20). The temperature required for heating the gas permeable layer (20) and the waterproof film (30) ranges between 110° C. and 130° C.

Then, the outer cover (40) is bonded to the waterproof film (30) by means of such as adhesion, and the lining (10) is then be bonded to the second side of the gas permeable layer (20) by means of such as adhesion, thereby forming a laminated layer including the lining (10), the gas permeable layer (20), the water-proof film (30) and the outer cover (40).

The laminated layer is then cut to the shape of the jacket (1) so as to form a plurality of cut edges. The peripheral cut edges of the laminated layer can then be bonded together.

Then, the bonded cut edges of the laminated layer can be sewed together to form a semi-finished jacket (1).

Finally, a zipper (12) is attached to the semi-finished jacket (1), thereby forming a finished jacket (1) as shown in FIG. 2.

Figure 6:
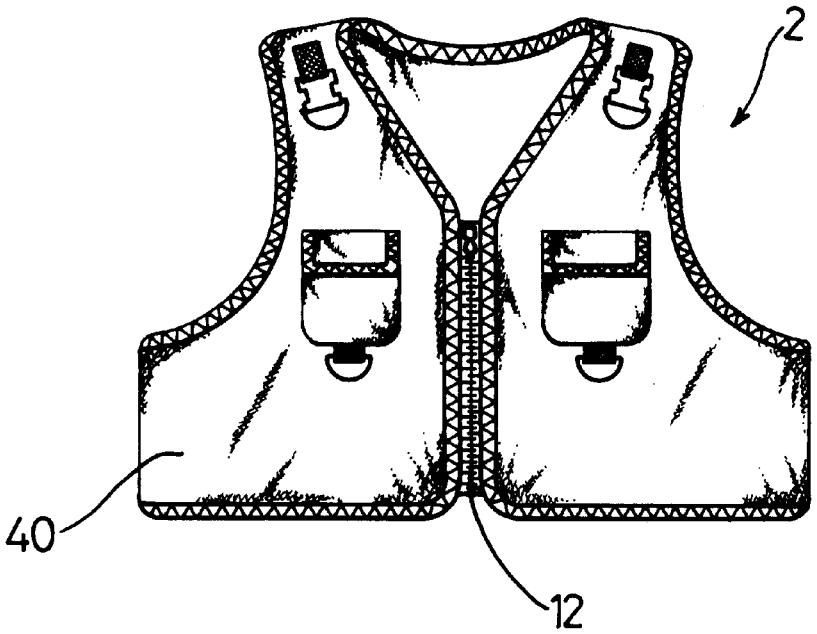
FIG. 6 is a front plan view of a waterproof and gas permeable vest in accordance with another embodiment of the present invention.

Referring now to FIG. 6, in accordance with another embodiment of the present invention, the waterproof and gas permeable clothing is in the form of a waterproof and gas permeable vest (2). The method for manufacturing the waterproof and gas permeable vest (2) is similar to that for manufacturing the waterproof and gas permeable jacket (1), and will not be further described in detail.

It should be clear to those skilled in the art that further embodiments may be made without departing from the scope and spirit of the present invention.

What is claimed is:

1. A method for manufacturing a waterproof and gas permeable jacket (1) comprising the steps of:

(a) providing a lining (10), a gas permeable layer (20) including a first side and a second side, a waterproof film (30), and an outer cover (40);

(b) forming a plurality of vent holes (21) through said gas permeable layer (20);

(c) bonding said waterproof film (30) onto said first side of said gas permeable layer (20);

(d) bonding said outer cover (40) to said waterproof film (30);

(e) bonding said lining (10) to said second side of said gas permeable layer (20) to form a laminated layer that includes said lining (10) which functions as an innermost layer, said gas permeable layer (20) which provides a ventilating effect, said waterproof film (30) which provides a waterproof function, and said outer cover (40) which functions as an outermost layer;

(f) cutting said laminated layer so as to form a plurality of cut edges;

(g) bonding said cut edges of said laminated layer together;

(h) sewing up said bonded cut edges of said laminated layer to form a semi-finished jacket (1); and (i) attaching a zipper to said semi-finished jacket (1) to form a finished jacket (1) that provides a ventilating and waterproof function to a wearer.

2. The method in accordance with claim 1, wherein said gas permeable layer (20) is made of a foam core material.

3. The method in accordance with claim 1, wherein said gas permeable layer (20) is made of a synthetic rubber.

4. The method in accordance with claim 1, after said step (c) further comprising the steps of:

providing a pair of a heating rollers (60); and conveying said gas permeable layer (20) together with said water-proof film (30) to be heated and pressurized between said pair of heating rollers (60).

5. The method in accordance with claim 4, wherein the temperature for heating said gas permeable layer (20) together with said waterproof film (30) ranges between 110° C. and 130° C.

* * * * *